US008786378B2

(12) United States Patent
Kroening

(10) Patent No.: US 8,786,378 B2
(45) Date of Patent: Jul. 22, 2014

(54) RECONFIGURABLE SWITCHING ELEMENT FOR OPERATION AS A CIRCULATOR OR POWER DIVIDER

(75) Inventor: Adam M. Kroening, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 160 days.

(21) Appl. No.: 13/588,418

(22) Filed: Aug. 17, 2012

(65) Prior Publication Data

US 2014/0049335 A1 Feb. 20, 2014

(51) Int. Cl.
*H01P 1/39* (2006.01)

(52) U.S. Cl.
CPC ..... *H01P 1/39* (2013.01)
USPC ..... 333/1.1

(58) Field of Classification Search
CPC ..... H01P 1/39
USPC ..... 333/1.1, 24.2
See application file for complete search history.

(56) References Cited

U.S. PATENT DOCUMENTS

| | | | |
|---|---|---|---|
| 3,070,760 | A | 12/1962 | Wheeler |
| 3,341,789 | A | 9/1967 | Goodman et al. |
| 3,935,548 | A | 1/1976 | Rosenbaum et al. |
| 4,058,780 | A | 11/1977 | Riblet |
| 4,309,666 | A | 1/1982 | Ito et al. |
| 4,604,590 | A | 8/1986 | Mlinar et al. |
| 4,697,158 | A | 9/1987 | Hoover et al. |
| 5,473,294 | A | 12/1995 | Mizzoni et al. |
| 6,292,068 | B1 | 9/2001 | Martin |
| 6,885,257 | B2 | 4/2005 | Kroening |
| 7,242,263 | B2 | 7/2007 | Kroening |
| 7,561,003 | B2 | 7/2009 | Kroening |
| 2003/0107447 | A1 | 6/2003 | Kroening |
| 2004/0119550 | A1 | 6/2004 | Trammell et al. |

(Continued)

FOREIGN PATENT DOCUMENTS

| | | |
|---|---|---|
| DE | 3026257 | 2/1982 |
| EP | 0239210 | 9/1987 |

(Continued)

OTHER PUBLICATIONS

European Patent Office, "Office Action from EP Application No. 13179326.7 mailed on Jan. 3, 2014", "from Foreign Counterpart of U.S. Appl. No. 13/588,374", Jan. 3, 2014, pp. 1-5, Published in: EP.

(Continued)

*Primary Examiner* — Stephen Jones
(74) *Attorney, Agent, or Firm* — Fogg & Powers LLC

(57) ABSTRACT

A device comprises a waveguide structure that includes multiple arms extending from the structure, wherein the arms connect to the structure; a switching element disposed in the structure and having multiple segments, each segment being associated with a waveguide arm, wherein the switching element has an E-plane aperture extending through the switching element, wherein the E-plane aperture is aligned perpendicularly to the H-plane; and an E-plane magnetizing winding inserted through the E-plane aperture such that current applied to the E-plane magnetizing winding establishes a magnetic field in the switching element that is aligned with the H-plane. In a further embodiment, the structure includes an H-plane aperture formed through each segment, the H-plane aperture aligned with the H-plane; and an H-plane magnetizing winding inserted through the H-plane apertures, wherein current applied to the H-plane magnetizing winding establishes a magnetic field in the switching element that is not aligned with the H-plane.

20 Claims, 6 Drawing Sheets

(56) References Cited

U.S. PATENT DOCUMENTS

| | | | |
|---|---|---|---|
| 2005/0179504 | A1 | 8/2005 | Kroening |
| 2006/0232353 | A1 | 10/2006 | Kroeing |
| 2006/0261909 | A1 | 11/2006 | Kroening |
| 2009/0108953 | A1 | 4/2009 | Kroening |
| 2010/0109791 | A1 | 5/2010 | Lingel |
| 2014/0049332 | A1 | 2/2014 | Kroening |
| 2014/0049333 | A1 | 2/2014 | Kroening |
| 2014/0049334 | A1 | 2/2014 | Kroening |

FOREIGN PATENT DOCUMENTS

| | | |
|---|---|---|
| JP | 51117853 | 10/1976 |
| JP | 52152145 | 12/1977 |
| SU | 1256109 | 9/1986 |
| WO | 8806807 | 9/1988 |

OTHER PUBLICATIONS

Billings et al., "Ferrite Circulator Switches and Their Applications", Nov. 2003, pp. 1-2.

Joubert, "Design of Unequal H-Plane Waveguide Power Dividers for Array Applications", Feb. 1997, pp. 1-6.

Liang et al., "A Rigorous Three Plane Mode-Matching Technique for Characterizing Waveguide T-Junctions, and its Application in Multiple", Dec. 12, 1991, pp. 2138-2147.

Lin Lin, "Theory and Design of Ferrite Latching Waveguide Junction Circulators", Dec. 1987, pp. 1-3.

Pozar, "10.6 Ferrite Circulators", Feb. 2004, pp. 1-4.

European Patent Office, "Office Action", "from Foreign Counterpart of U.S. Appl. No. 13/588,314", Dec. 16, 2013, pp. 1-9, Published in: EP.

European Patent Office, "European Search Report", "from Foreign Counterpart of U.S. Appl. No. 13/588,314", Dec. 3, 2013, pp. 1-5, Published in: EP.

European Patent Office, "Office Action", "from Foreign Counterpart of U.S. Appl. No. 13/588,337", Dec. 9, 2013, pp. 1-6, Published in: EP.

European Patent Office, "European Search Report", "from Foreign Counterpart of U.S. Appl. No. 13/588,337", Nov. 26, 2013, pp. 1-4, Published in: EP.

European Patent Office, "European Search Report", "from Foreign Counterpart of U.S. Appl. No. 13/588,374", Dec. 9, 2013, pp. 1-3, Published in: EP.

RECONFIGURABLE SWITCHING ELEMENT FOR OPERATION AS A CIRCULATOR OR POWER DIVIDER

BACKGROUND

Circulators have a wide variety of uses in commercial and military, space and terrestrial, and low and high power applications. A waveguide circulator may be implemented in a variety of applications, including but not limited to low noise amplifier (LNA) redundancy switches, T/R modules, isolators for high power sources, and switch matrices. One important application for such waveguide circulators is in space, for example, in satellites, where reliability is essential and where size and weight are important. Circulators made from a ferrite material are desirable for these applications because of their high reliability due to their lack of moving parts, which moving parts could wear down over time.

Generally, ferrite circulators are three arm devices used to route RF energy from a first waveguide arm to a second waveguide arm, while isolating a third waveguide arm. If switched to circulate in the opposite direction, they then can route RF energy from the first waveguide arm to the third waveguide arm, while isolating the second waveguide arm. This functionality is used in RF systems such as beam forming networks and switched beam antennas to reconfigure the antenna pattern of the system. In this manner, the switching circulators route the RF energy from a single source to a single radiating antenna element. However, some antennas have multiple antenna elements and to route RF energy from a single source to multiple radiating antenna elements, the circulators are combined with other waveguide components, such as magic tees.

For the reasons stated above and for other reasons stated below which will become apparent to those skilled in the art upon reading and understanding the specification, there is a need in the art for a ferrite circulator that can be reconfigured to operate as either a circulator or a power divider.

SUMMARY

The embodiments of the present disclosure provide systems and methods for a reconfigurable switching element for operation as a circulator or power divider and will be understood by reading and studying the following specification.

Systems and methods for a reconfigurable switching element for operation as a circulator or a power divider are provided. In certain embodiments, a waveguide device, comprises a waveguide structure, the waveguide structure including a plurality of arms extending from the waveguide structure, wherein the plurality of arms connect to the waveguide structure, the longitudinal axes of the plurality of arms defining an H-plane; a switching element disposed in the waveguide structure and having a plurality of segments matching, where each segment in the plurality of segments is associated with a waveguide arm in the plurality of arms, wherein the switching element has at least one E-plane aperture extending through the switching element, wherein the E-plane aperture is aligned perpendicularly to the H-plane; and at least one E-plane magnetizing winding inserted through the at least one E-plane aperture such that current applied to the at least one E-plane magnetizing winding establishes a magnetic field in the switching element that is aligned with the H-plane.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize features relevant to the present invention. Reference characters denote like elements throughout figures and text.

DETAILED DESCRIPTION

Figure 1:
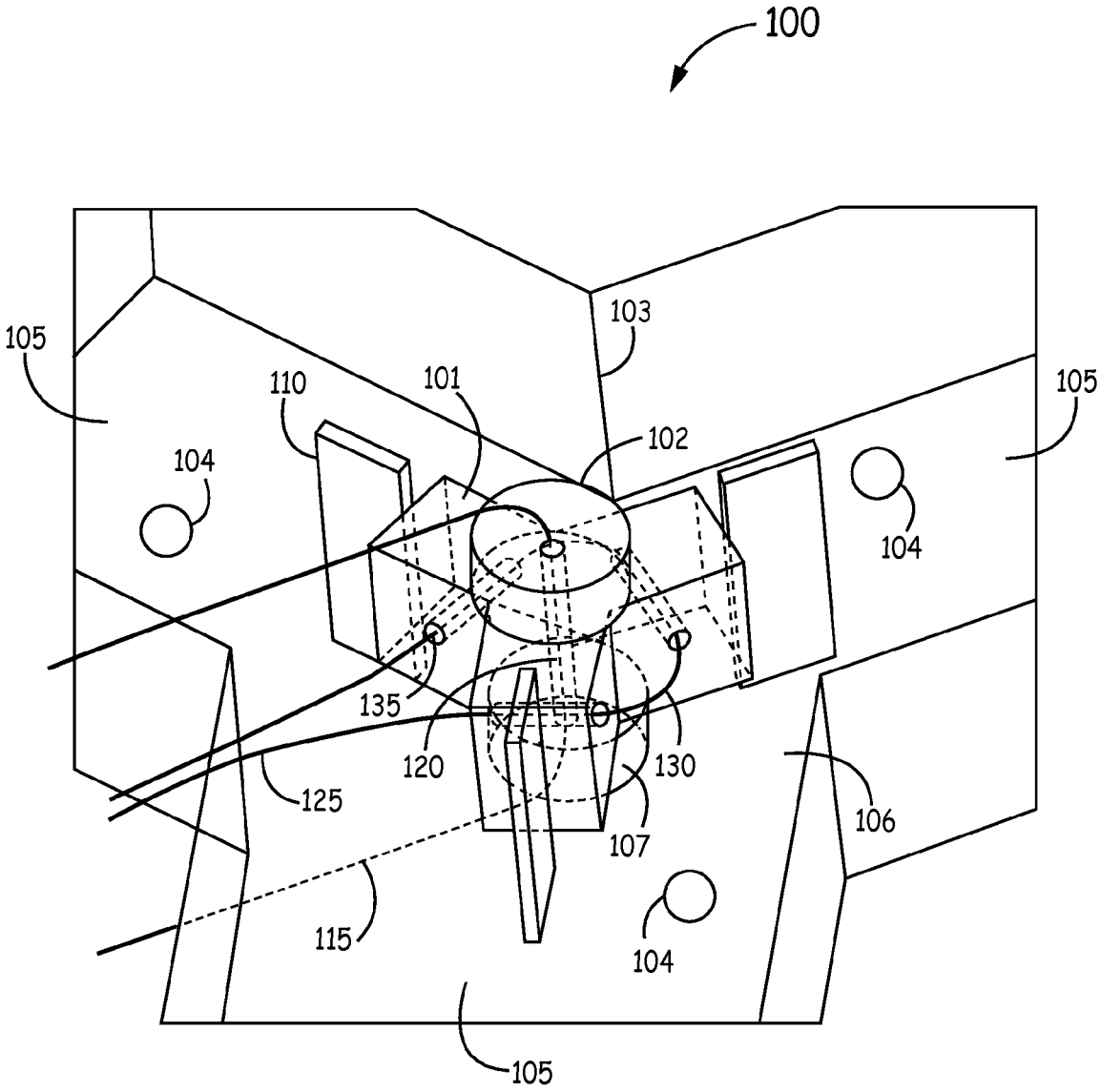
FIG. 1 is a block diagram illustrating a waveguide circulator according to one embodiment.

In the following detailed description, reference is made to the accompanying drawings that form a part hereof, and in which is shown by way of illustrating specific illustrative embodiments. However, it is to be understood that other embodiments may be utilized and that logical, mechanical, and electrical changes may be made. Furthermore, the method presented in the drawing figures and the specification is not to be construed as limiting the order in which the individual steps may be performed. The following detailed description is, therefore, not to be taken in a limiting sense.

As described below in detail, the present disclosure describes various embodiments for a reconfigurable switching element, where the switching element is reconfigurable to operate as either a circulator or a power divider within a waveguide arm junction. The switching element is reconfigurable because two magnetizing electrical windings are threaded through apertures in the switching element. The two magnetizing electrical windings are arranged in mutually orthogonal planes within the switching element. Because of the orthogonal arrangement of the apertures, when current is applied to the different magnetizing electrical windings at different times, the switching element becomes magnetized in orthogonal directions. For example, current run through one magnetizing winding magnetizes the switching element in a direction that interacts with RF energy propagating in the waveguide and causes the switching element to function like a circulator. Current run through the other magnetizing winding magnetizes the switching element in a direction that does not interact with the RF energy propagating in the waveguide such that the switching element functions as a power divider.

FIG. 1 is a diagram of a waveguide circulator structure 100 according to one embodiment described in the present disclosure. Waveguide circulator structure 100 connects to waveguide arms 105. Waveguide arms 105 are waveguides that extend from waveguide circulator structure 100, where the waveguide arms 105 convey microwave energy to and from waveguide circulator structure 100. In at least one embodiment, multiple waveguide arms 105 are connected to each other at waveguide circulator structure 100, where the waveguide arms 105 are arranged in a y-shape, extending away from the waveguide circulator structure 100. Also, in some implementations, waveguide arms 105 are arranged in the H-plane about the waveguide circulator structure 100 at intervals of 120 degrees, where the H-plane is defined as the plane containing the magnetic field vector of the dominant electromagnetic wave in each waveguide arm 105, which is parallel to the plane of the longitudinal axes of the guides comprising the arms.

In certain embodiments, waveguide circulator structure 100 includes an internal cavity 106 that encloses a switching element 101. Switching element 101 is made from a non-reciprocal material such as a ferrite, where the non-reciprocal material is such that the relationship between an oscillating current and the resulting electric field changes if the location where the current is placed and the where the field is measured changes. Magnetic fields created in switching element 101, can be used to circulate a microwave signal that propagates in one waveguide arm 105 to propagate in another waveguide arm 105 connected to the waveguide circulator structure 100. The reversing of the direction of the magnetic field created in the switching element 101 reverses the direction of circulating within switching element 101. The reversing of the direction of circulating within switching element 101 also switches which waveguide arm 105 propagates the signal away from switching element 101. In at least one exemplary embodiment, a waveguide circulator structure 100 is connected to three waveguide arms 105, where one of waveguide arms 105 functions as an input arm and two waveguide arms 105 function as output arms. The input waveguide arm 105 propagates microwave energy into waveguide circulator structure 100, where the waveguide circulator structure 100 circulates the microwave signal through switching element 101 and out one of the two output waveguide arms 105. In one implementation, when the magnetic fields are changed, the microwave signal is circulated through switching element 101 and out the other of the two output waveguide arms 105. Thus, a switching element 101 has a selectable direction of circulation. RF energy received through one waveguide arm 105 can be routed with a low insertion loss from the one waveguide arm 105 to either of the other output waveguide arms 105. Further, the induced magnetic field in switching element 101 can be further changed such that switching element 101 acts like a power divider as compared to a circulator In certain implementations, segments of switching element 101 protrude into the separate waveguide arms 105. For example, switching element 101 can be a Y-shaped switching element 101. However, switching element 101 can be other shapes as well, such as a triangular puck, a cylinder, and the like. In at least one implementation, switching element 101 is a switchable or latchable ferrite circulator. To make switching element 101 switchable, H-plane magnetizing windings 125 are threaded through H-plane apertures 135 in the segments of switching element 101 that protrude into the separate waveguide arms 105, where the H-plane apertures are parallel to the H-plane. H-plane apertures 135 are created by boring a hole through a segment of switching element 101 that protrudes into each separate waveguide arm 105 and then threading H-plane magnetizing winding 125 through H-plane apertures 135. In one implementation, H-plane magnetizing windings 125 enter the inner cavity of waveguide circulator 100 between the two waveguide arms 105 that are not receiving RF energy, which reduces the interaction of the H-plane magnetizing winding 125 with the RF energy on the input waveguide arm 105. H-plane magnetizing winding 125 allows for the control and establishment of an out-of-plane magnetic field in switching element 101, where a portion of the out-of-plane magnetic field is not parallel with the H-plane in a resonant section 130 of the switching element 101. In a further implementation, a portion of the out-of-plane magnetic field is a perpendicular to the H-Plane and aligned with an E-plane. The polarity of the magnetic field can be switched back-and-forth by the application of current on H-plane magnetizing winding 125 to create a switchable circulator. For example, the application of a pulse with a current between 4 and 12 amperes to H-plane magnetizing winding 125 magnetizes switching element 101 such that switching element 101 circulates RF energy received on an input waveguide arm 105 to one of the two remaining waveguide arms 105. Applying a current in the opposite direction through H-plane magnetizing winding 125 switches the direction of magnetization such that switching element 101 circulates RF energy received on the input waveguide arm 105 to the other remaining waveguide arm 105. Further, the portion of switching element 101 where the three segments of the element converge and to the inside of the three H-plane apertures 135 is a resonant section 130 of switching element 101. The dimensions of this section determine the operating frequency for circulation in accordance with conventional design and theory. The three protruding sections, or legs of switching element 101 towards the outside of horizontal apertures 135 act both as return paths for the bias fields in resonant section 130 and as impedance transformers out of resonant section 130.

In certain implementations, a quarter wave dielectric transformer 110 is attached to the ends of switching element 101 that are farthest away from the middle of the switching element 101. The quarter wave dielectric transformers 110 aid in the transition from a switching element 101 to an air-filled waveguide arm 105. Dielectric transformers 110 are typically used to match the lower impedance of a switching element 101 to that of the air-filled waveguide arms 105. In alternative implementations, switching element 101 transitions to the air-filled waveguide arm 105 without an aiding dielectric transformer 110. To transition directly, without an aiding transformer, from switching element 101 to the air-filled waveguide arm 105, switching element 101 may be designed so that the impedance of the switching element 101 matches the impedance of the air-filled waveguide arm 105. For example, the switching element 101 is designed to be narrower than corresponding switching elements that are designed to interface with dielectric transformers 110. Further, the material that is used to fabricate the switching element 101 is selected to have a particular saturation magnetization value, such that the impedance of the switching element 101 matches the impedance of the air filled waveguide arm 105.

In further embodiments, a top dielectric spacer 102 is disposed on the top surface of switching element 101 that is parallel to the H-plane. Spacer 102 is used to position switching element 101 in the waveguide housing and to provide a thermal path out of switching element 101 for high power applications. Generally, a second dielectric spacer 107 would be used, located on the side of switching element 101 that is opposite spacer 102. All of the components described above are disposed within the inner cavity 106 of the conductive waveguide circulator structure 100. The conductive waveguide circulator structure 100 is generally air-filled and also includes waveguide input/output arms 105 that provide interfaces for signal input and output. Empirical matching elements 104 can be disposed on the surface of the conductive waveguide circulator structure 100 to improve the impedance matching. The matching elements 104 are generally capacitive/inductive dielectric or metallic buttons that are used to empirically improve the impedance match over the desired operating frequency band.

In certain embodiments, waveguide circulator 100 is further capable of changing the magnetization of switching element 101 such that waveguide circulator 100 functions as a power divider. To make switching element 101 switchable between operating as a circulator and operating as a power divider, waveguide circulator 100 includes an E-plane magnetizing winding 115 which is threaded through an E-plane aperture 120, where both the E-plane magnetizing winding 115 and the E-plane aperture 120 are perpendicularly aligned with respect to the H-plane. E-plane aperture 120 is created by boring a hole that extends between surfaces of switching element 101, where the surfaces are aligned with the H-plane and the longitudinal axes of the E-plane aperture is perpendicular to the H-plane. In the present exemplary embodiment, the E-plane aperture 120 passes substantially through the center of switching element 101. Further, the E-plane magnetizing winding 115 is threaded through the E-plane aperture 120. In some implementations, E-plane aperture 120 also extends through top spacer 102 and bottom spacer 107. Further, in at least one exemplary implementation, E-plane aperture 120 also extends through the surfaces of waveguide circulator 100 that are aligned with the H-plane. In certain embodiments, the E-plane magnetizing winding 115 enters the E-plane aperture 120 through the surfaces of waveguide circulator 100 that are aligned with the H-plane.

In at least one embodiment, E-plane magnetizing winding 115 allows for the control and establishment of a magnetic field in switching element 101 that is aligned with the H-plane. When the magnetic field 109 in switching element 101 is aligned with the H-plane, the magnetic field does not interact with the RF energy propagating in waveguide circulator 100, the RF energy received through an input waveguide arm 105 affects switching element 101 as if switching element 101 were a dielectric and the power of the RF energy is split equally through the other two waveguide arms 105. Thus, the application of the current through the E-plane magnetizing winding 115 causes waveguide circulator 100 to function as a power divider. In at least one exemplary implementation, to establish the magnetic field in switching element 101 that does not interact with RF energy propagating through waveguide circulator 100, a current between 1 and 12 amperes is pulsed through E-plane magnetizing winding 115. The direction of the current can be applied in either direction as current applied in both directions will establish the magnetic field that is parallel to the H-plane such that the magnetic field does not interact with the RF energy propagating through waveguide circulator 100. As described above, through the use of both E-plane magnetizing windings 115 and H-plane magnetizing windings 125, waveguide circulator 100 is able to switch between functioning as a circulator and a power divider.

Figure 2:
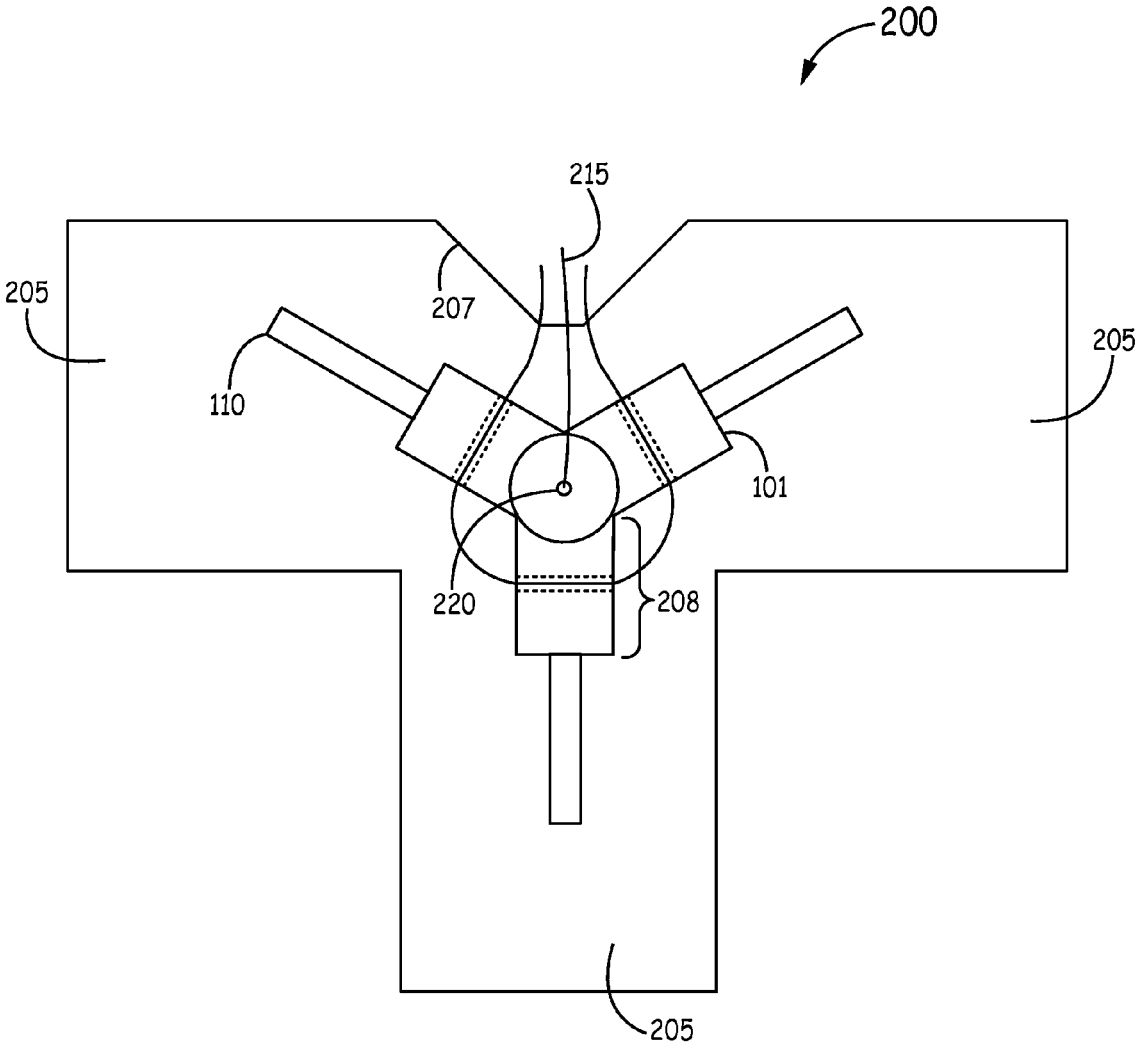
FIG. 2 is a block diagram illustrating a waveguide circulator where the waveguide circulator is organized in T-shape according to one embodiment of the waveguide circulator.

FIG. 2 is a drawing illustrating a waveguide circulator 200, where waveguide arms 205 are arranged in a "Tee" Layout. For example, waveguide circulator 200 includes a switching element 101 that is substantially similar to switching element 101 in FIG. 1 and dielectric transformers 110 that are substantially similar to dielectric transformers 110 in FIG. 1. Waveguide circulator 200 differs from waveguide circulator 100 in that two waveguide arms 205 are oriented 180° apart from one another. The third waveguide arm 205 is centered at 90° away from the other two legs. Further, the waveguide arms 205 that are oriented 180° apart from one another are separated by a septum 207, where septum 207 is a structure that increases the impedance between the two waveguide arms that are oriented 180° apart from one another and also helps to match the impedance between the segments 208 of switching element 101.

In at least one embodiment, an E-plane aperture 220 extends through switching element 101 substantially as described above with respect to FIG. 1. For example, E-plane aperture 220 extends through substantially the middle of switching element 101. An E-plane magnetizing winding 215 extends through the vertical aperture 220 and, in some implementations extends through the surfaces of waveguide circulator 200 that are aligned with the H-plane of waveguide circulator 200.

Figure 3:
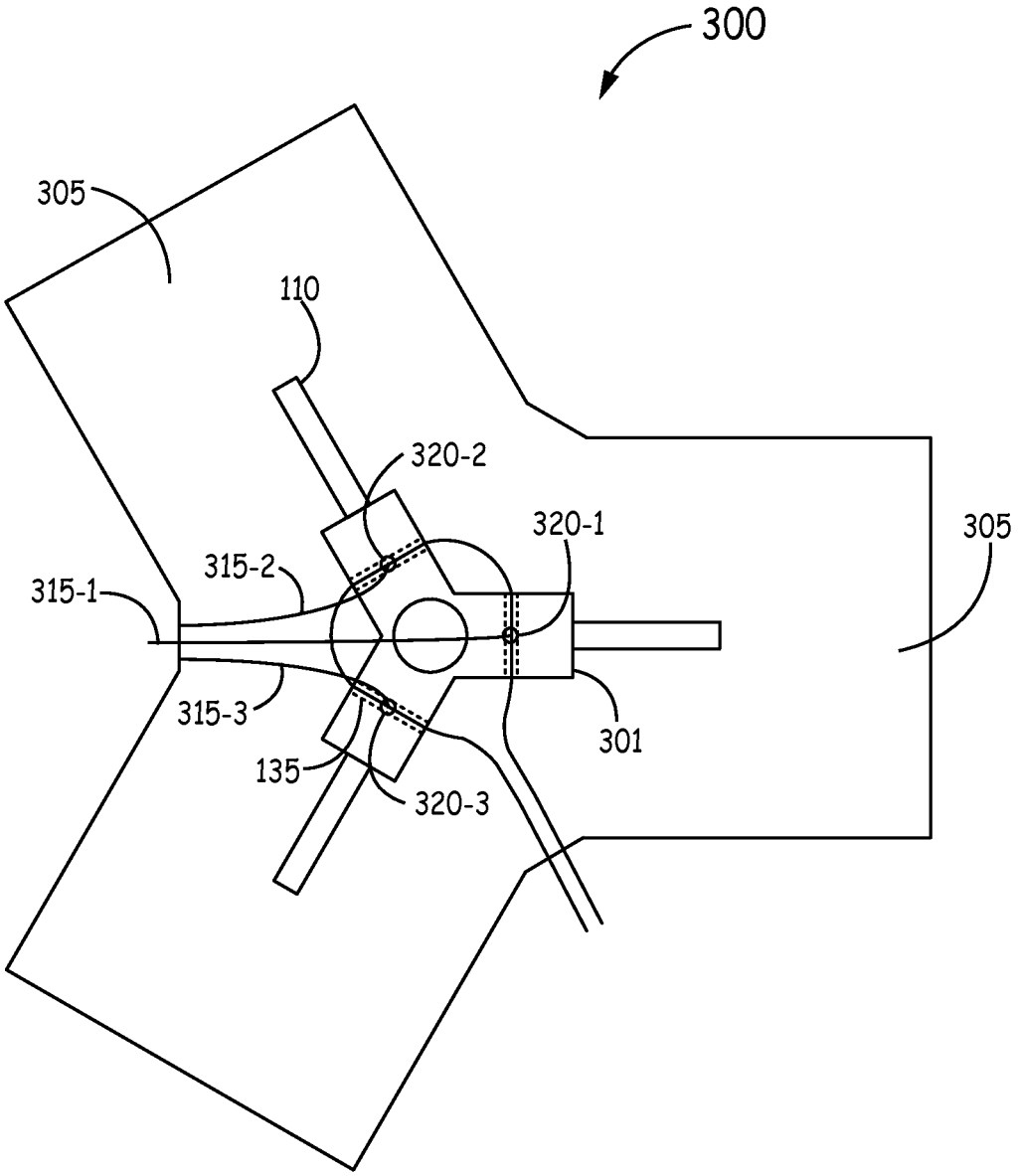
FIG. 3 is a block diagram illustrating a waveguide circulator that uses multiple magnetic windings to configure a power divider according to one embodiment.

FIG. 3 is a drawing illustrating the top view of waveguide circulator 300 having multiple E-plane apertures 320-1-320-3 to configure the switching element 301 for power division. As shown in the present exemplary implementation, the waveguide circulator 300 includes waveguide arms 305 that are arranged about the waveguide circulator 300 in a Y-shape. In at least one embodiment, the waveguide arms 305 are arranged in a similar manner to waveguide arms 105 in FIG. 1. Further, waveguide circulator 300 includes dielectric transformers 110 that are substantially similar to dielectric transformers 110 in FIG. 1. However, in contrast to the previously described embodiments, waveguide circulator 300 includes multiple E-plane apertures 320-1-320-3 that extend through the different segments of the switching element 101 at locations that are equidistant from the center of the switching element 301. In at least one embodiment, the E-plane apertures 320-1-320-3 extend through H-plane apertures 135, which are substantially similar to H-plane apertures described in FIG. 1. Further, multiple E-plane magnetizing windings 315-1-315-3 extend through E-plane apertures 320-1-320-3. In one implementation, the multiple E-Plane magnetizing windings 315-1-315-3 include a separate wire that corresponds to each E-plane magnetizing winding 315-1-315-3. Alternatively, the multiple E-Plane magnetizing windings 315-1-315-3 include a single wire that is threaded through the E-plane apertures 320-1-320-3. Both the E-plane magnetizing windings 315-1-315-3, and the E-plane apertures 320-1-320-3 are aligned perpendicularly to the H-plane as the E-plane magnetizing windings 315-1-315-3. The perpendicular alignment with respect to the H-plane limits the interaction of the E-plane magnetizing windings 315-1-315-3 with RF energy propagating through waveguide arms 305.

Figure 4:
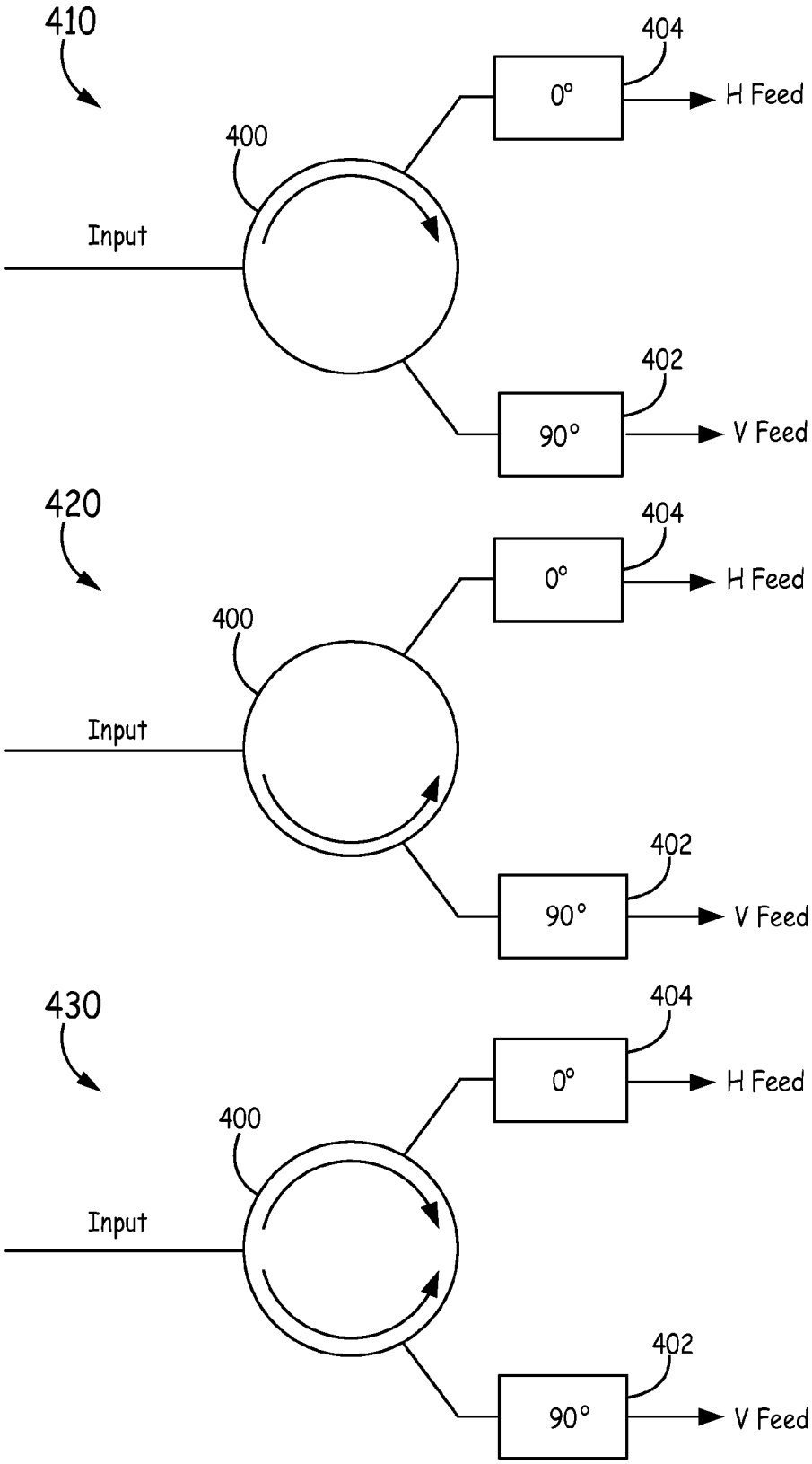
FIG. 4 is a diagram illustrating the implementation of a circulator in forming different polarizations on an antenna according to one embodiment.

In certain implementations, a waveguide circulator and power divider is used to provide RF energy to a radiating antenna. Certain radiating antennas have different RF feeds, for example, an antenna can have an H feed, where the H stands for horizontal, and a V feed, where the V stands for vertical. The transmission of RF energy on both the H feed and the V feed at different phase delays can determine the polarization of the signal that is transmitted from the antenna. FIG. 4 depicts different polarizations formed using a waveguide circulator 400 as described in relation to FIGS. 1-3. For example, waveguide circulator 400 includes an input arm and two output arms. One of the output arms is coupled to a 90° phase delay element 402 which delays the received signal by 90° and is in turn coupled to a V feed for the antenna. The other output arm is coupled to a 0° phase delay element 404 which passes a non-delayed signal to the H Feed. By circulating RF energy received from the input arm of waveguide circulator 400 or power dividing the RF energy, the polarization of the signal transmitted from a radiating antenna can be controlled. For example, FIG. 4 illustrates 3 different polarizations for the radiating antenna: a horizontal polarization 410, a vertical polarization 420, and a left hand circular polarization 430. To form horizontal polarization 410, waveguide circulator 400 circulates the received RF energy towards the output arm coupled to 0° phase delay element 404, which transmits the RF energy to the H Feed of the antenna. To form vertical polarization 420, waveguide circulator 400 circulates the received RF energy towards the output arm coupled to 90° phase delay element 402, which transmits the RF energy to the V Feed of the antenna. To form left hand circular polarization 430, waveguide circulator 400 divides the received RF energy and transmits half of the energy toward 90° phase delay element 402 and transmits the other half of the energy towards 0° phase delay element 404. The phase of the signal that reaches the antenna through the V feed is delayed 90° behind the phase of the signal that reaches the antenna through the H feed, thus the antenna transmits signals that are left hand circularly polarized.

Figure 5:
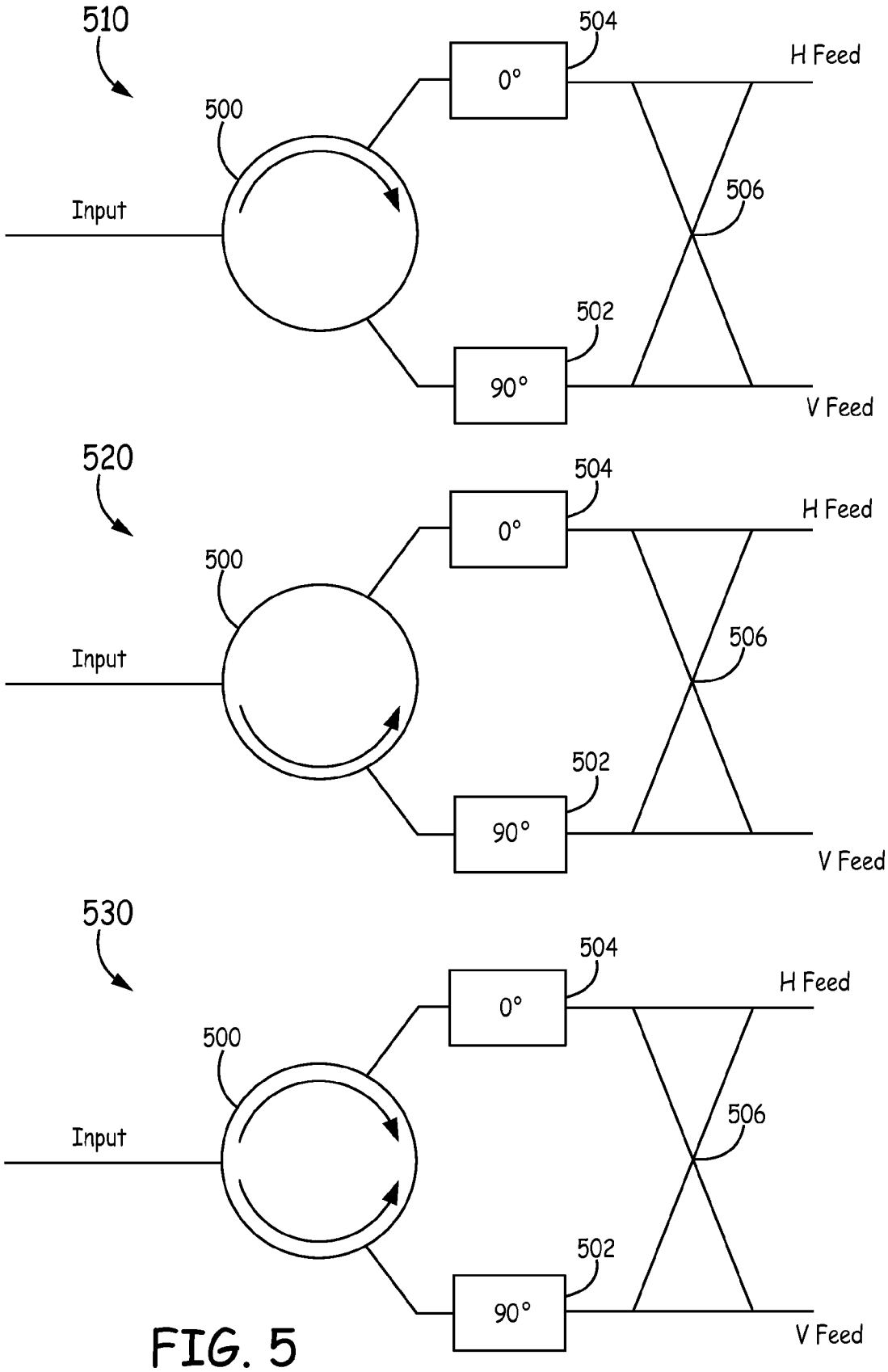
FIG. 5 is a diagram illustrating the implementation of a circulator in forming different polarizations on an antenna according to one embodiment.

FIG. 5 illustrates different polarizations formed using a waveguide circulator 500 as described in relation to FIGS. 1 and 2. For example, waveguide circulator 500 is connected to an H feed and a V feed for an antenna as described above in relation to FIG. 4, however, the V feed and the H feed are further coupled to one another by a quadrature 3 dB combiner/splitter 506. As illustrated in FIG. 5, by changing the circulation and power division for waveguide circulator 500, waveguide circulator 500 is able to provide signals to the antenna that are radiated in a left hand circular polarization 510, a right hand circular polarization 520, and a vertical polarization 530. To form left hand circular polarization 510, waveguide circulator 500 circulates the received RF energy towards the output arm coupled to 0° phase delay element 504, which quadrature 3 dB combiner/splitter 506 splits the power to both the H feed and the V feed and delays the signal to the V feed by 90°. To form right hand circular polarization 520, waveguide circulator 500 circulates the received RF energy towards the output arm coupled to 90° phase delay element 502, where quadrature 3 dB combiner/splitter 506 splits the power to both the H feed and the V feed and delays the signal to the H feed by 90°. To form vertical polarization 530, waveguide circulator 500 divides the received RF energy and routes half of the energy toward 90° phase delay element 502 and routes the other half of the RF energy toward 0° phase delay element 504. Quadrature 3 dB combiner/splitter 506 splits the power received from 0° phase delay element 504, such that half of the power from 0° phase delay element 504 is routed to H feed at a total delay of 0° and half is routed to V feed at a total delay of 90°. Further, after being delayed, quadrature 3 dB combiner/splitter 506 splits the power received from 90° phase delay element 502. Half of the power from 90° phase delay element 502 is routed to V feed at a total delay of 90° and half is routed to H feed at a total delay of 180°. Because the signals received at H feed are delayed at both 0° and 180°, the signals destructively interfere with one another, while the signals received at V feed are both delayed 90° and constructively interfere. Thus due to the destructive interference, no signal is transmitted through H feed and the full signal is transmitted through the V feed.

Figure 6:
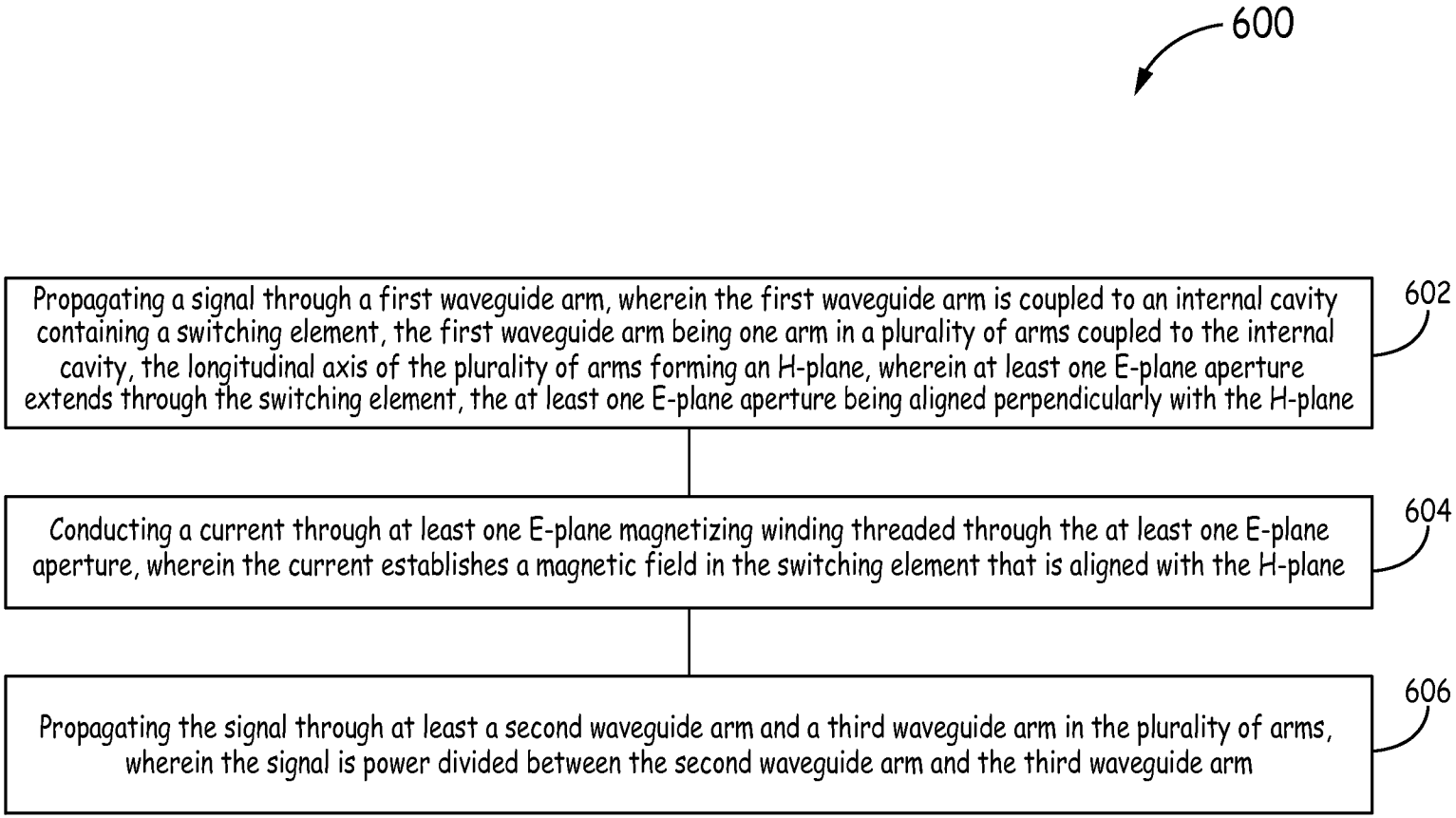
FIG. 6 is a flow diagram illustrating a method for power division within a waveguide circulator according to one embodiment.

FIG. 6 is a flow diagram illustrating a method 600 for power division within a waveguide circulator. The method 600 proceeds at 602 where a signal is propagated through a first waveguide arm, wherein the first waveguide arm is coupled to an internal cavity containing a switching element, the first waveguide arm being one arm in a plurality of arms coupled to the internal cavity, the longitudinal axis of the plurality of arms forming an H-plane, wherein an E-plane aperture extends through the switching element, the E-plane aperture being aligned perpendicularly to the n.

The method 600 proceeds at 604 where a current is conducted through an E-plane magnetizing winding threaded through the E-plane aperture, wherein the current establishes a magnetic field in the switching element that is aligned with the H-plane. The method 600 proceeds at 606 where the signal is propagated through at least a second waveguide arm and a third waveguide arm in the plurality of arms, wherein the signal is power divided between the second waveguide arm and the third waveguide arm. Further, the waveguide circulator can be reconfigured to function as a circulator by conducting a current through an H-plane magnetizing winding that is aligned with the H-plane, where the H-plane magnetizing winding extends through an H-plane aperture in the switching element.

EXAMPLE EMBODIMENTS

Example 1 includes a waveguide device, comprising a waveguide structure, the waveguide structure comprising a plurality of arms extending from the waveguide structure, wherein the plurality of arms connect to the waveguide structure, the longitudinal axes of the plurality of arms defining an H-plane; a switching element disposed in the waveguide structure and having a plurality of segments, each segment in the plurality of segments being associated with a waveguide arm in the plurality of arms, wherein the switching element has at least one E-plane aperture extending through the switching element, wherein the at least one E-plane aperture is aligned perpendicularly to the H-plane; and at least one E-plane magnetizing winding inserted through the at least one E-plane aperture such that current applied to the at least one E-plane magnetizing winding establishes a magnetic field in the switching element that is aligned with the H-plane.

Example 2 includes the waveguide device of Example 1, comprising an H-plane aperture formed through each segment in the plurality of segments, the H-plane aperture being aligned with the H-plane; and an H-plane magnetizing winding inserted through the H-plane apertures such that current applied to the H-plane magnetizing winding establishes a magnetic field in the switching element that is perpendicular to the H-plane.

Example 3 includes the waveguide device of any of Examples 1-2, comprising a quarter wave dielectric transformer formed on the end of each segment in the plurality of segments.

Example 4 includes the waveguide device of any of Examples 1-3, comprising at least one empirical impedance matching element placed within the waveguide structure.

Example 5 includes the waveguide device of any of Examples 1-4, comprising at least one spacer, the at least one spacer positioning the switching element within the waveguide structure.

Example 6 includes the waveguide device of Example 5, wherein the at least one E-plane aperture extends through the at least one spacer.

Example 7 includes the waveguide device of any of Examples 1-6, wherein the switching element is y-shaped and the plurality of segments are spaced 120 degrees apart from one another.

Example 8 includes the waveguide device of any of Examples 1-7, wherein the plurality of arms are in a y-shaped orientation and spaced 120 degrees apart from one another.

Example 9 includes the waveguide device of any of Examples 1-8, wherein the waveguide structure has three arms and a first and a second arm in the three arms are spaced 180 degrees apart from one another around the waveguide structure and a third arm in the three arms is spaced 90 degrees apart from both the first and second arm around the waveguide structure.

Example 10 includes the waveguide device of Example 9, wherein the waveguide structure has a septum between the first and second arms and opposite the third arm.

Example 11 includes an antenna feed device, comprising at least one antenna feed configured to provide signals to an antenna; a waveguide device comprising a plurality of waveguide arms configured for the propagation of waves, wherein the plurality of waveguide arms are coupled to either receive radio frequency energy or transmit the radio frequency energy to the at least one antenna feed, the longitudinal axes of the plurality of arms forming an H-plane; an internal cavity; a switching element disposed in the internal cavity, wherein a plurality of switching element segments extend into the plurality of waveguide arms wherein the switching element has at least one E-plane aperture extending through the switching element, wherein the at least one E-plane aperture is aligned perpendicularly to the H-plane; and at least one E-plane magnetizing winding inserted through the at least one E-plane aperture such that current applied to the wire establishes a magnetic field in the switching element that is aligned with the H-plane.

Example 12 includes the antenna feed device of Example 11, comprising an H-plane aperture formed through each leg in the plurality of legs; and an H-plane magnetizing winding inserted through the horizontal apertures such that current applied to the H-plane magnetizing winding establishes a magnetic field in the switching element that is perpendicular to the H-plane.

Example 13 includes the antenna feed device of any of Examples 11-12, wherein the at least one antenna feed comprises a vertical feed and a horizontal feed.

Example 14 includes the antenna feed device of Example 13, wherein the radio frequency energy that is relayed to the horizontal feed is delayed by 90 degrees.

Example 15 includes the antenna feed device of any of Examples 13-14, wherein the vertical feed and the horizontal feed are coupled to one another by a quadrature 3 dB combiner/splitter.

Example 16 includes the antenna feed device of any of Examples 11-15, wherein the plurality of arms are in a y-shaped orientation and spaced 120 degrees apart from one another.

Example 17 includes the antenna feed device of any of Examples 11-16, wherein the waveguide structure has three arms and a first and a second arm in the three arms are spaced 180 degrees apart from one another and a third arm in the three arms is spaced 90 degrees apart from both the first and second arm.

Example 18 includes the antenna feed device of Example 17, wherein a septum is between the first and second arms.

Example 19 includes a method for power division in a waveguide circulator, comprising propagating a signal through a first waveguide arm, wherein the first waveguide arm is coupled to an internal cavity containing a switching element, the first waveguide arm being one arm in a plurality of arms coupled to the internal cavity, the longitudinal axis of the plurality of arms forming an H-plane, wherein at least one E-plane aperture extends through the switching element, the at least one E-plane aperture being aligned perpendicularly with the H-plane; conducting a current through at least one E-plane magnetizing winding threaded through the at least one E-plane aperture, wherein the current establishes a magnetic field in the switching element that is aligned with the H-plane; and propagating the signal through at least a second waveguide arm and a third waveguide arm in the plurality of arms, wherein the signal is power divided between the second waveguide arm and the third waveguide arm.

Example 20 includes the method of Example 19, further comprising conducting a current through an H-plane magnetizing winding threaded through at least one H-plane-aperture formed in the switching element, wherein the H-plane magnetizing winding and the H-plane aperture are both aligned with the H-plane, wherein the current establishes a magnetic field in the switching element that is perpendicularly aligned with the H-plane; circulating the signal from the first waveguide arm to one of the second waveguide arm and the third waveguide arm.

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

What is claimed is:

1. A waveguide device, comprising:

a waveguide structure, the waveguide structure comprising a plurality of arms extending from the waveguide structure, wherein the plurality of arms connect to the waveguide structure, the longitudinal axes of the plurality of arms defining an H-plane;

a switching element disposed in the waveguide structure and having a plurality of segments, each segment in the plurality of segments being associated with a waveguide arm in the plurality of arms, wherein the switching element has at least one E-plane aperture extending through the switching element, wherein the at least one E-plane aperture is aligned perpendicularly to the H-plane; and at least one E-plane magnetizing winding inserted through the at least one E-plane aperture such that current applied to the at least one E-plane magnetizing winding establishes a magnetic field in the switching element that is aligned with the H-plane.

2. The waveguide device of claim 1, comprising:

an H-plane aperture formed through each segment in the plurality of segments, the H-plane aperture being aligned with the H-plane; and an H-plane magnetizing winding inserted through the H-plane apertures such that current applied to the H-plane magnetizing winding establishes a magnetic field in the switching element, wherein a portion of the magnetic field established by the current applied to the H-plane magnetizing winding is not aligned with the H-plane.

3. The waveguide device of claim 1, comprising a quarter wave dielectric transformer formed on the end of each segment in the plurality of segments.

4. The waveguide device of claim 1, comprising at least one empirical impedance matching element placed within the waveguide structure.

5. The waveguide device of claim 1, wherein the switching element is y-shaped and the plurality of segments are spaced 120 degrees apart from one another.

6. The waveguide device of claim 1, wherein the plurality of arms are in a y-shaped orientation and spaced 120 degrees apart from one another.

7. The waveguide device of claim 1, comprising at least one spacer, the at least one spacer positioning the switching element within the waveguide structure.

8. The waveguide device of claim 7, wherein the at least one E-plane aperture extends through the at least one spacer.

9. The waveguide device of claim 1, wherein the waveguide structure has three arms and a first and a second arm in the three arms are spaced 180 degrees apart from one another around the waveguide structure and a third arm in the three arms is spaced 90 degrees apart from both the first and second arm around the waveguide structure.

10. The waveguide device of claim 9, wherein the waveguide structure has a septum between the first and second arms and opposite the third arm.

11. An antenna feed device, comprising:

at least one antenna feed configured to provide signals to an antenna;

a waveguide device comprising:

a plurality of waveguide arms configured for the propagation of waves, wherein the plurality of waveguide arms are coupled to either receive radio frequency energy or transmit the radio frequency energy to the at least one antenna feed, the longitudinal axes of the plurality of arms forming an H-plane;

an internal cavity;

a switching element disposed in the internal cavity, wherein a plurality of switching element segments extend into the plurality of waveguide arms wherein the switching element has at least one E-plane aperture extending through the switching element, wherein the at least one E-plane aperture is aligned perpendicularly to the H-plane; and at least one E-plane magnetizing winding inserted through the at least one E-plane aperture such that current applied to the wire establishes a magnetic field in the switching element that is aligned with the H-plane.

12. The antenna feed device of claim 11, comprising:

an H-plane aperture formed through each arm in the plurality of arms; and an H-plane magnetizing winding inserted through the horizontal apertures such that current applied to the H-plane magnetizing winding establishes a magnetic field in the switching element, wherein a portion of the magnetic field established by the current applied to the H-plane magnetizing winding is not aligned with the H-plane.

13. The antenna feed device of claim 11, wherein the plurality of arms are in a y-shaped orientation and spaced 120 degrees apart from one another.

14. The antenna feed device of claim 11, wherein the waveguide structure has three arms and a first and a second arm in the three arms are spaced 180 degrees apart from one another and a third arm in the three arms is spaced 90 degrees apart from both the first and second arm.

15. The antenna feed device of claim 14, wherein a septum is between the first and second arms.

16. The antenna feed device of claim 11, wherein the at least one antenna feed comprises a vertical feed and a horizontal feed.

17. The antenna feed device of claim 16, wherein the radio frequency energy that is relayed to the horizontal feed is delayed by 90 degrees.

18. The antenna feed device of claim 16, wherein the vertical feed and the horizontal feed are coupled to one another by a quadrature 3 dB combiner/splitter.

19. A method for power division in a waveguide circulator, comprising:

propagating a signal through a first waveguide arm, wherein the first waveguide arm is coupled to an internal cavity containing a switching element, the first waveguide arm being one arm in a plurality of arms coupled to the internal cavity, the longitudinal axis of the plurality of arms forming an H-plane, wherein at least one E-plane aperture extends through the switching element, the at least one E-plane aperture being aligned perpendicularly with the H-plane;

conducting a current through at least one E-plane magnetizing winding threaded through the at least one E-plane aperture, wherein the current establishes a magnetic field in the switching element that is aligned with the H-plane; and propagating the signal through at least a second waveguide arm and a third waveguide arm in the plurality of arms, wherein the signal is power divided between the second waveguide arm and the third waveguide arm.

20. The method of claim 19, further comprising:

conducting a current through an H-plane magnetizing winding threaded through at least one H-plane-aperture formed in the switching element, wherein the H-plane magnetizing winding and the H-plane aperture are both aligned with the H-plane, wherein the current establishes a magnetic field in the switching element, wherein a portion of the magnetic field established by the current applied to the H-plane magnetizing winding is not aligned with the H-plane;

circulating the signal from the first waveguide arm to one of the second waveguide arm and the third waveguide arm.

* * * * *